US006039034A

United States Patent [19]

Field et al.

[11] Patent Number: 6,039,034

[45] Date of Patent: Mar. 21, 2000

[54] EXHAUST GAS RECIRCULATION VALVE

[75] Inventors: Martin John Field, Leighton Buzzard, United Kingdom; Bernd Jakob Ballmert, Schifflange, Luxembourg; Laurence Alexander Collins, Athus, Belgium; Robert James Moran, Peterborough, United Kingdom

[73] Assignee: General Motors Corporation, Detroit, Mich.

[21] Appl. No.: 09/148,848

[22] Filed: Sep. 4, 1998

[30] Foreign Application Priority Data

Sep. 4, 1997 [GB] United Kingdom ..... 9718679

[51] Int. Cl.[7] ..... F02M 25/07

[52] U.S. Cl. ..... 123/568.23; 123/568.18; 123/568.19

[58] Field of Search ..... 123/568.11, 568.18, 123/568.19, 568.21, 568.23, 568.24, 568.25; 251/129.11

[56] References Cited

U.S. PATENT DOCUMENTS

| | | | |
|---|---|---|---|
| 3,675,633 | 7/1972 | Nakajima et al. | 123/568.19 |
| 4,010,929 | 3/1977 | Pollock | 251/260 |
| 4,027,636 | 6/1977 | Yamamoto et al. | 123/568.19 |
| 4,064,851 | 12/1977 | Wessel | 123/568.19 |
| 4,094,285 | 6/1978 | Oyama et al. | 123/568.23 |
| 4,144,856 | 3/1979 | Tsukamoto et al. | 123/568.19 |
| 4,233,946 | 11/1980 | Yorioka et al. | 123/568.19 |
| 4,561,408 | 12/1985 | Jenkins | 123/568.23 |
| 4,690,119 | 9/1987 | Makino et al. | 123/568.23 |
| 4,805,667 | 2/1989 | Kimura | 251/129.11 |
| 4,840,350 | 6/1989 | Cook | 251/129.11 |
| 5,263,681 | 11/1993 | Laux | 251/129.11 |
| 5,342,026 | 8/1994 | Dean | 251/85 |

FOREIGN PATENT DOCUMENTS

| | | |
|---|---|---|
| 0349729 | 10/1990 | European Pat. Off. . |
| 3606722 | 10/1987 | Germany . |
| 4040760 | 6/1991 | Germany . |
| 8901105 | 9/1989 | WIPO . |

*Primary Examiner*—Willis R. Wolfe
*Attorney, Agent, or Firm*—Vincent A. Cichosz

[57] ABSTRACT

An exhaust gas recirculation valve (10) for installation between an air intake and an exhaust of an engine comprising a housing (12) having a first bore (14) for connection with the air intake and a second bore (16) for receiving exhaust gas from the exhaust, the second bore being at an angle to the first bore and opening into the first bore; a valve stem (24) extending from the first bore into the second bore; a valve seat (28) in the second bore at the opening (18) of the second bore into the first bore; a valve head (30) on the valve stem within the second bore and normally in engagement with the valve seat; eccentric drive means (42) rotatably mounted in the first bore and connected to the valve stem; actuating means (34) mounted on the housing and connected to the eccentric drive means, which, on actuation, rotates the eccentric drive means to move the valve stem to disengage the valve head from the valve seat. EGR valve suitable for a diesel engine or other types of engine.

6 Claims, 5 Drawing Sheets

EXHAUST GAS RECIRCULATION VALVE

TECHNICAL FIELD

The present invention relates to an exhaust gas recirculation valve (EGR valve) for a diesel engine or a gasoline direct injection (GDI) engine.

BACKGROUND OF THE INVENTION

Exhaust gas recirculation is used to allow a controlled amount of oxygen depleted exhaust gas to be mixed with inlet air flowing to an engine for combustion in the cylinders of the engine. EGR valves are used to reduce $NO_x$ emissions from engine exhaust gases. Electrically actuated EGR valves are now well known for current petrol/gasoline engines. However, these designs of EGR valve are generally unsuitable for diesel engines due to the substantially different requirements and operating conditions of a diesel engine when compared to a petrol/gasoline engine. Diesel engines using EGR valves are known, but these EGR valves are operated by large vacuum operated diaphragms which are generally too slow.

SUMMARY OF THE INVENTION

It is an object of the present invention to provide an EGR valve which is suitable for use with an engine which requires high EGR rates.

An exhaust gas recirculation valve in accordance with the present invention for installation between an air intake and an exhaust of an engine comprises a housing having a first bore for connection with the air intake and a second bore for receiving exhaust gas from the exhaust, the second bore being at an angle to the first bore and opening into the first bore; a valve stem extending from the first bore into the second bore; a valve seat in the second bore at the opening of the second bore into the first bore; a valve head on the valve stem within the second bore and normally in engagement with the valve seat; eccentric drive means rotatably mounted in the first bore and connected to the valve stem; actuating means mounted on the housing and connected to the eccentric drive means, which, on actuation, rotates the eccentric drive means to move the valve stem to disengage the valve head from the valve seat.

The present invention provides an EGR valve which is suitable for use with a diesel engine or an engine requiring high EGR rates, such as a GDI engine. The present invention may also be suitable for use with current petrol/gasoline engines.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
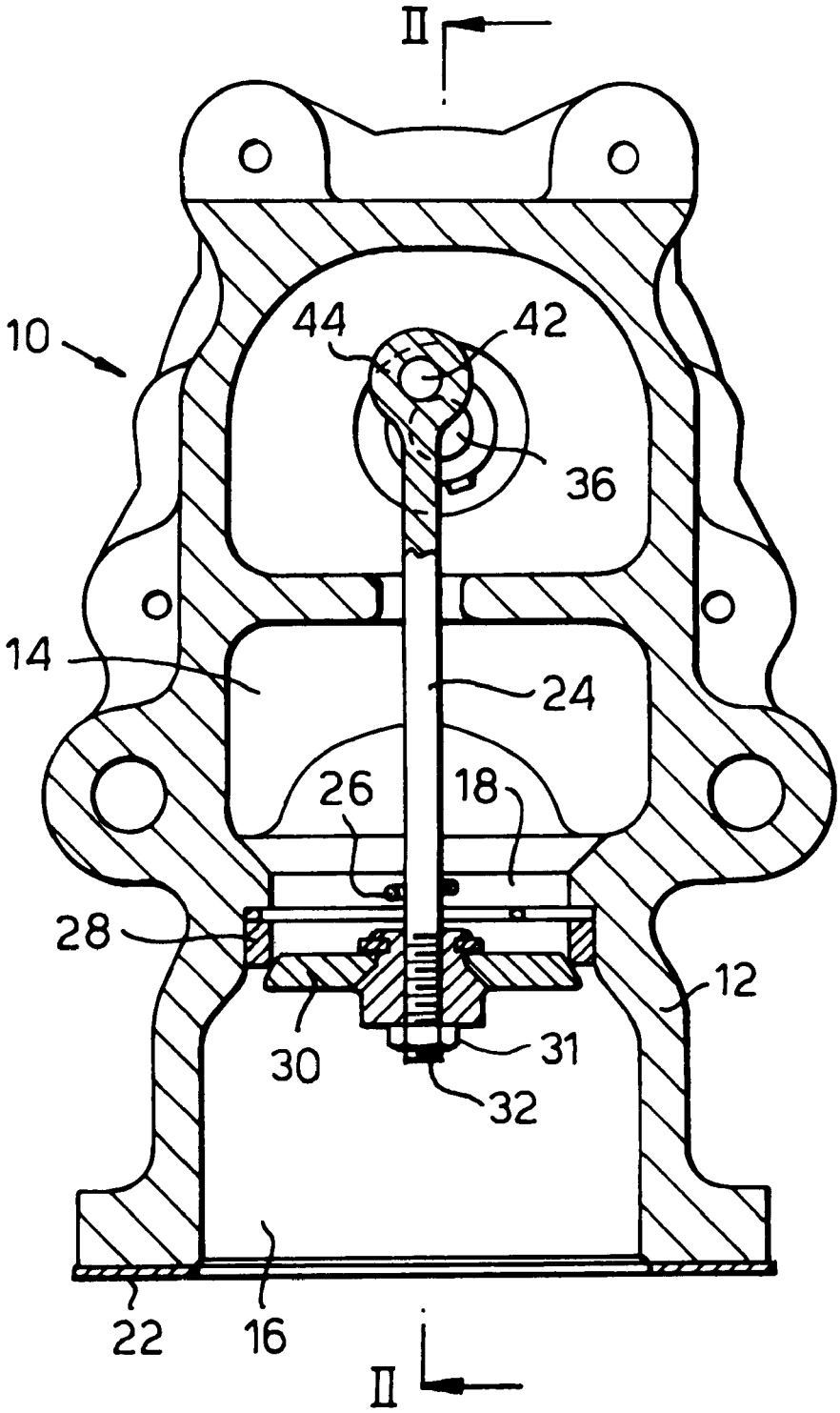
FIG. 1 is a cross-sectional view on the line I—I of FIG. 2 of a first embodiment of exhaust gas recirculation valve in accordance with the present invention.
Figure 2:
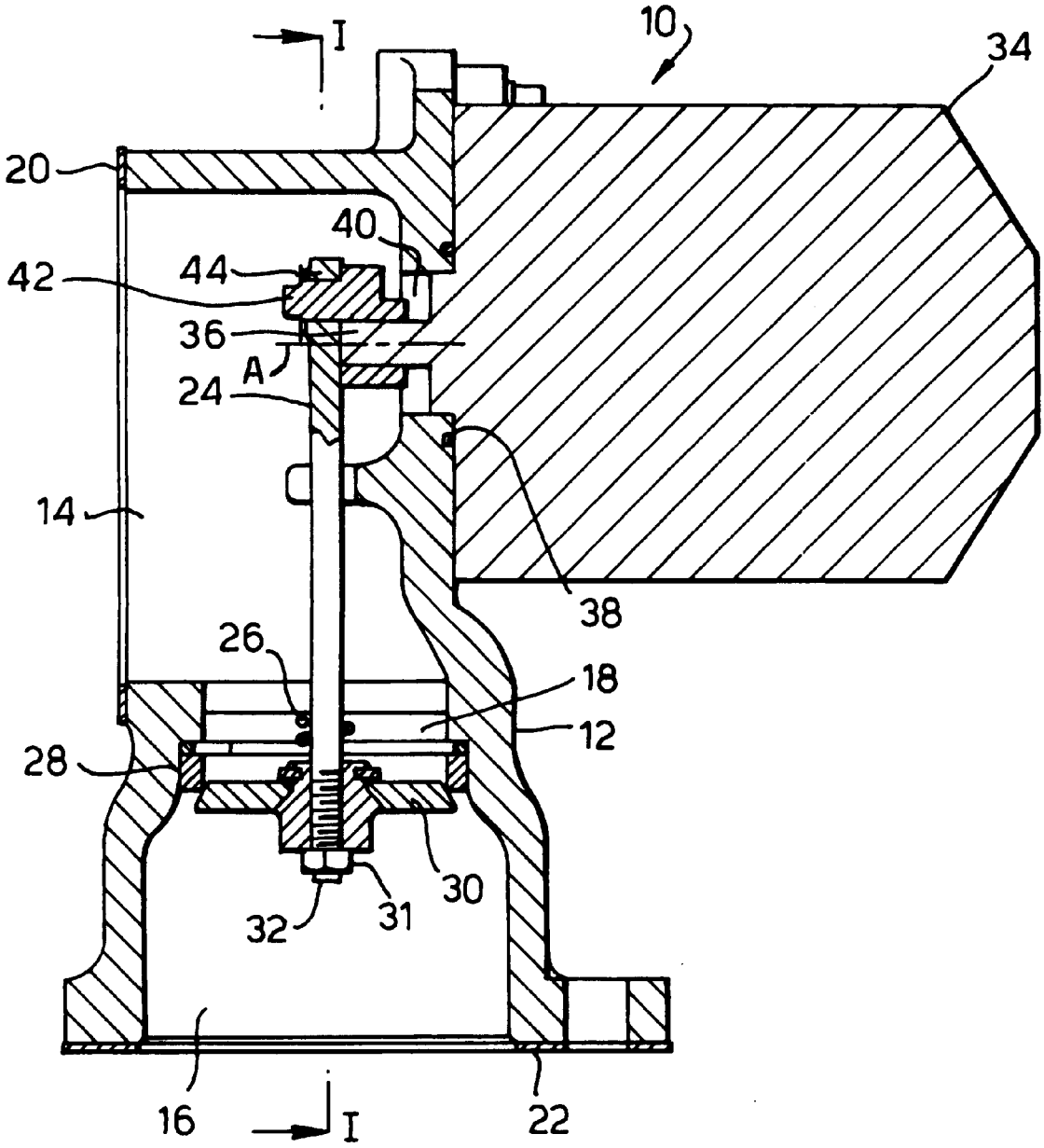
FIG. 2 is a cross-sectional view on the line II—II of FIG. 1.

Referring to FIGS. 1 and 2, the first embodiment of exhaust gas recirculation (EGR) valve 10 in accordance with the present invention is shown which can be installed between an air intake and an exhaust of a diesel or other engine of a motor vehicle. The EGR valve 10 includes a housing 12 having a first bore 14 for connection with the air intake and a second bore 16 for receiving exhaust gas from the exhaust. The second bore 16 is preferably substantially perpendicular to the first bore 14, and the second bore opens into the first bore at an opening 18. A gasket 20 can be used to provide a seal at the connection of the first bore 14 to an opening in the air intake manifold (not shown) to the diesel engine. Similarly, a gasket 22 can be used to provide a seal at the connection of the second bore 16 to an opening in the exhaust pipe (not shown) from the diesel engine.

A valve stem 24 extends from the first bore 14 through a guide 26 mounted in the opening 18 and into the second bore 16. A valve seat 28 is mounted in the second bore 16 at the opening 18. The valve seat 28 is either a separate insert, as shown, or may be integrally formed in the housing 12. A valve head 30 is secured on the end 32 of the valve stem 24 within the second bore 16, and normally engages the valve seat 28 to close the opening 18. The initial position of the valve head 30 is set by threading the valve head onto the valve stem 24, and then fixing the valve head with a locking nut 31, or by welding, or by any other suitable means. Alternatively, the valve head may be integrally formed with the valve stem.

Actuating means in the form of an electric motor 34 is mounted on the housing 12 and has a shaft 36 which extends into the first bore 14. An O-ring seal 38 or any other suitable seal or gasket seals the opening 40 in the housing 12 through which the shaft 36 extends. The shaft 36 is rotatable by the electric motor 34 about an axis A which extends in a direction which is substantially perpendicular to the second bore 16. A journal eccentric 42 is mounted on the shaft 36. The journal eccentric 42 is rotatably secured to the other end 44 of the valve stem 24 and a position which is offset from the axis A. Rotation of the shaft 36 by the electric motor 34 therefore rotates the journal eccentric about axis A, which causes the valve stem 24 to reciprocate along its axis, thereby moving the valve head 30 into and out of engagement with the valve seat 28. Actuation of the electric motor 34 therefore opens the opening 18 to allow exhaust gas to enter the air intake to the engine. The operation of the electric motor 34 may be controlled by any suitable means, but is preferably operated dependent on signals from an engine control system which may calculate from suitable sensors (not shown) the required position of the valve stem 24. On de-actuation of the electric motor 34, the valve head 30 moves back into engagement with the valve seat 28 under the influence of exhaust gas pressure acting on the valve head and/or a return spring (not shown) which acts directly on the valve mechanism and/or on the actuating means.

The present invention provides an EGR valve 10 which is suitable for use with a diesel engine of a motor vehicle, especially diesel engines up to around 3000 cc. The arrangement of the valve head 30 and valve seat 28 allows any exhaust gas which seeps past the valve head to enter the air intake manifold reducing the risk of seepage to atmosphere.

The arrangement of the valve head 30 being positioned in the second bore 16 reduces the exposure of the eccentric mechanism to exhaust gas, thereby reducing the risk of corrosion damage to, and carbon build up on, the eccentric mechanism. Closing of the valve head 30 against the valve seat 28 under the influence of exhaust gas pressure and/or the return spring(s) provides a fail-safe arrangement for the EGR valve 10 in that the valve will be closed should the electric motor 34 fail.

Figure 4:
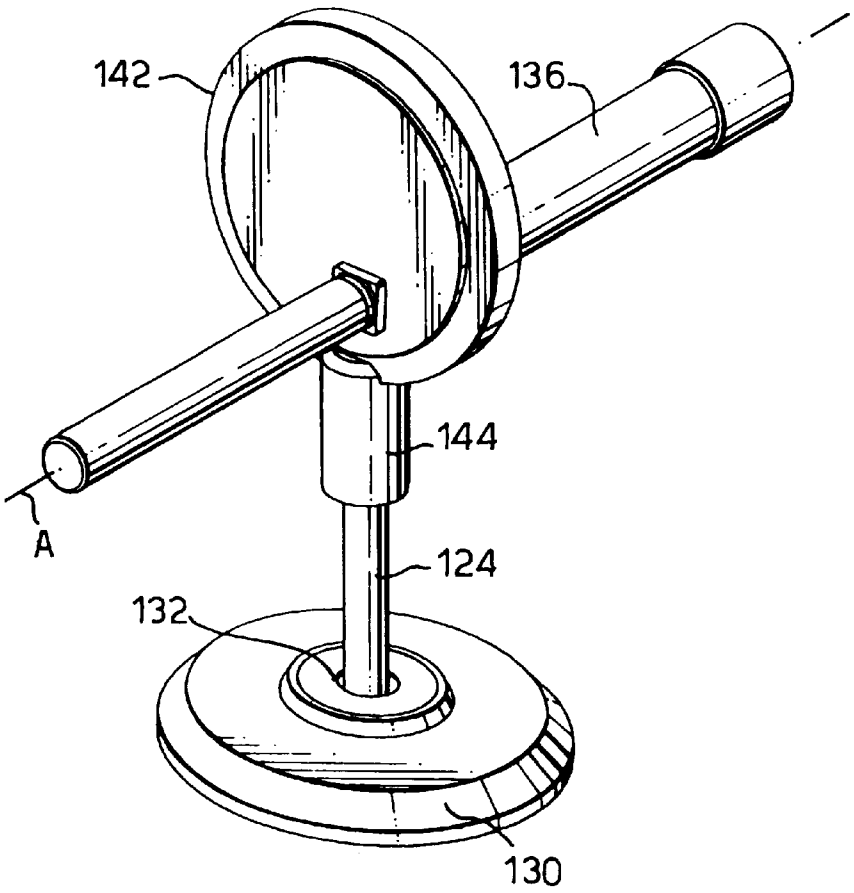
FIG. 4 is a side view of the valve stem, valve head and eccentric drive of the exhaust gas recirculation valve of FIG. 3.
Figure 3:
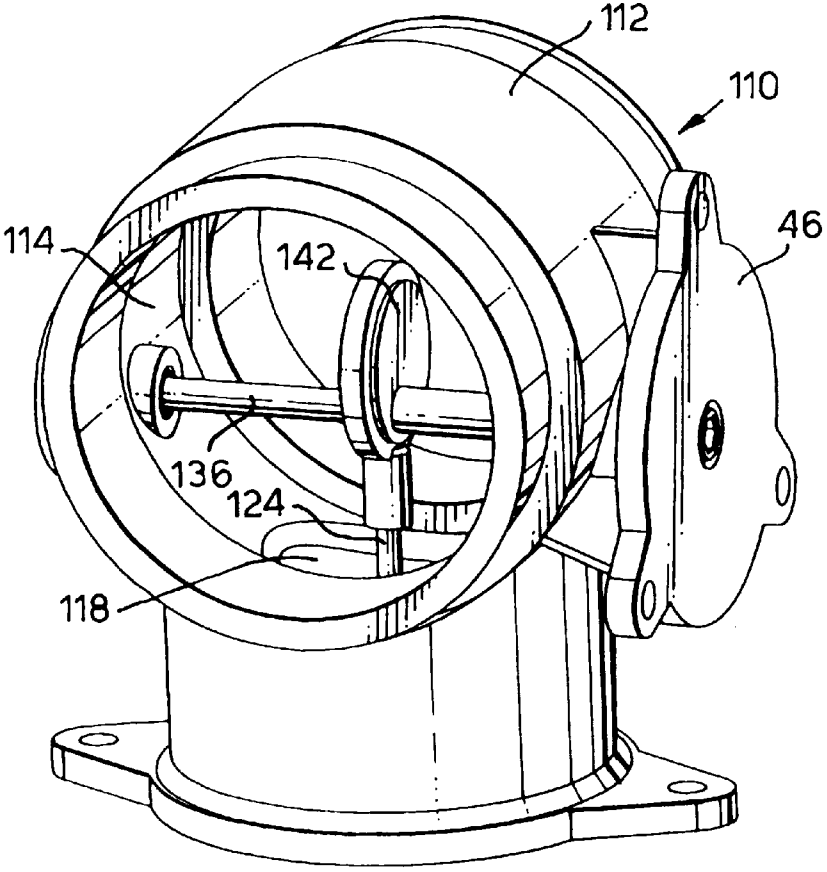
FIG. 3 is a side view of a second embodiment of exhaust gas recirculation valve in accordance with the present invention, with the electric motor omitted for clarity.
Figure 5:
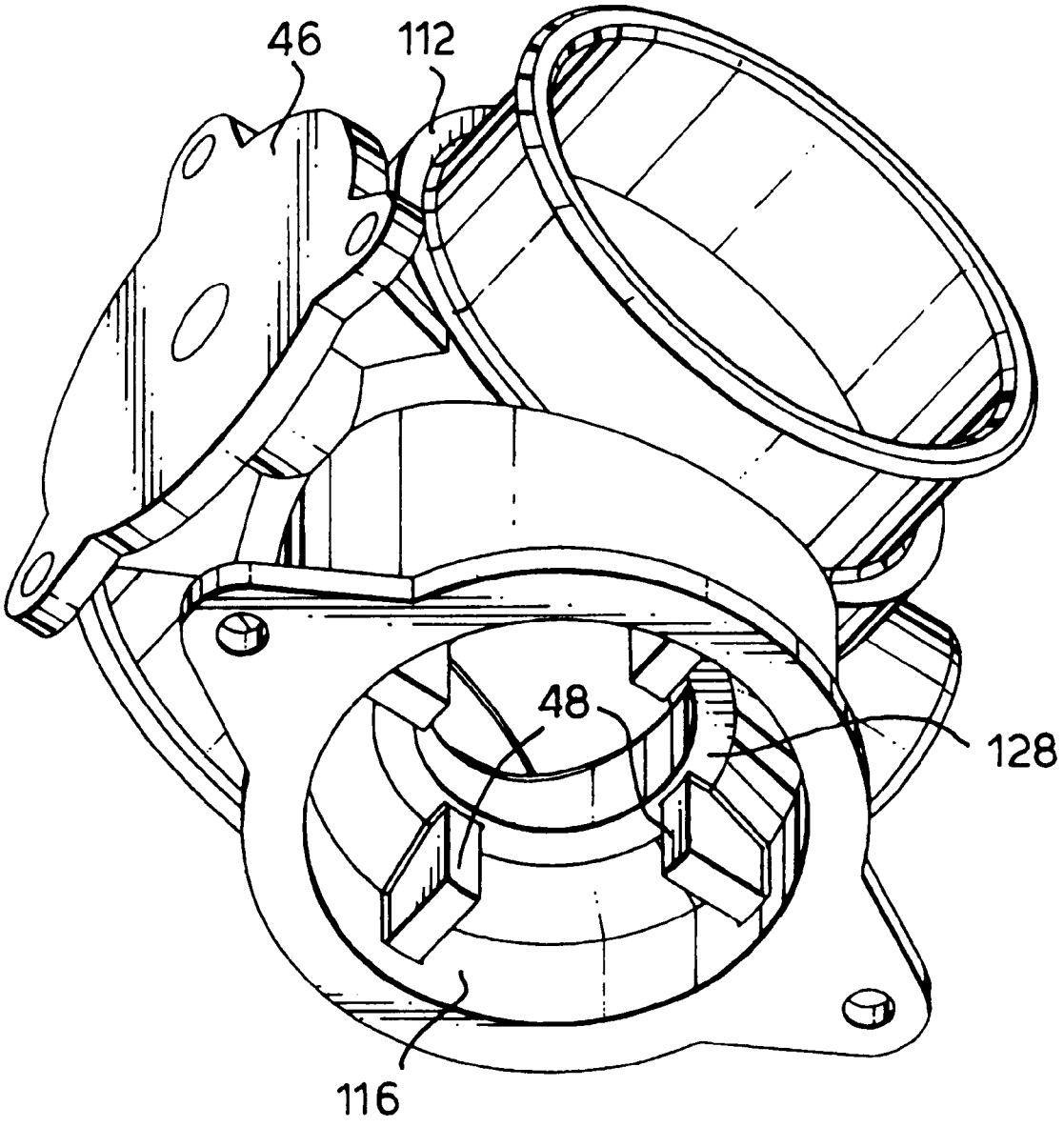
FIG. 5 is a bottom view of the housing of the exhaust gas recirculation valve of FIG. 3.

The second embodiment of EGR valve 110 in accordance with the present invention, as shown in FIGS. 3 to 5, is a modification of the first embodiment, and where appropriate like parts have been given the same reference number but prefixed by 100. The electric motor has been omitted for clarity but is mounted on plate 46 on the housing 112. In this second embodiment, the first bore 114 is locatable in the air intake manifold for the diesel engine, and the housing 112 therefore forms part of the air intake manifold. The shaft 136, which is rotated by the electric motor, preferably extends across the first bore 114. The shaft 136 and the journal eccentric 142 are therefore positioned in the flow path of the air to the diesel engine. The second bore 116 has guide walls 48 therein which ensure that the valve head 130 remains substantially axially aligned with the valve seat 128 during movement of the valve head.

Figure 8:
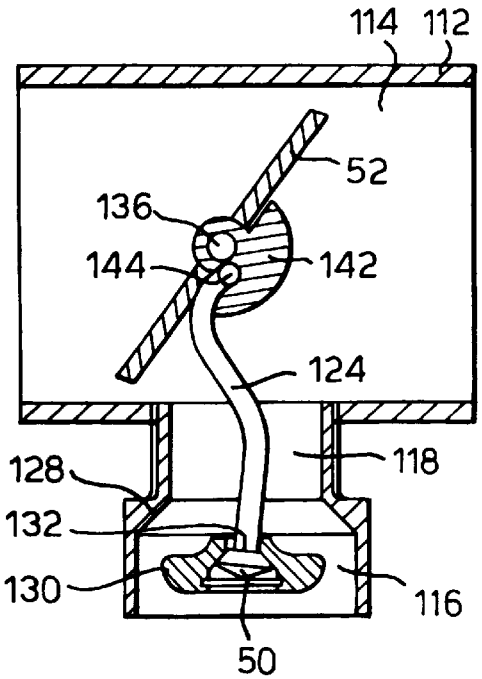
FIGS. 6 to 8 are cross-sectional views of a modification to the exhaust gas recirculation valve of FIG. 3 at various stages of operation.
Figure 7:
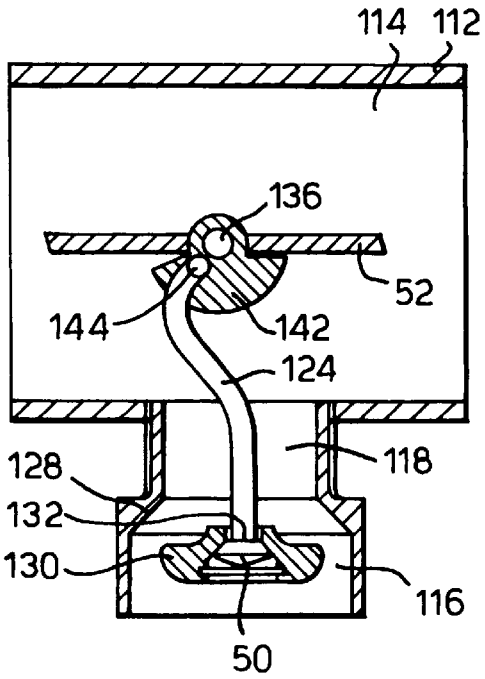
Figure 6:
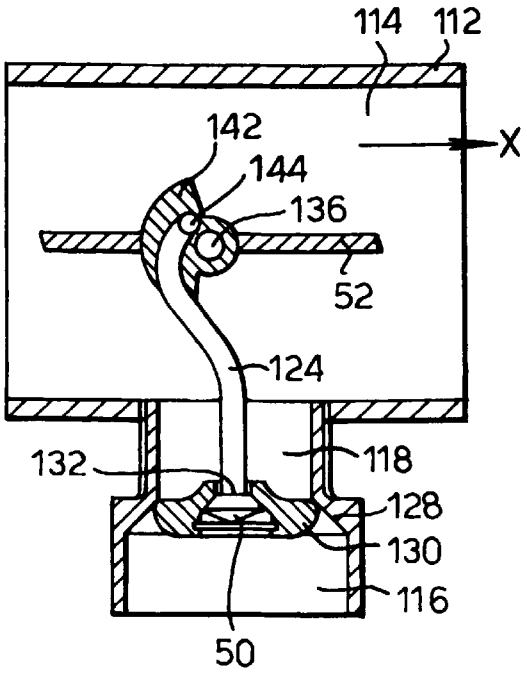

The second embodiment may be further modified as shown in FIGS. 6 to 8. In this modification, the valve stem 124 is preferably connected to the valve head 130 by a ball joint 50 to assist alignment of the valve head with the valve seat 128, and a flap valve or strangler 52 is rotatably mounted on the shaft 136 and is movable by the journal eccentric 142 at certain orientations of the journal eccentric. In FIG. 6, the EGR valve is closed and air passes through the first bore 114 (in the direction of arrow X) with substantially no restriction. In FIG. 7, the EGR valve is open and air passes through the first bore 114 with substantially no restriction to mix with exhaust gas entering through the second bore 116. In FIG. 8, the EGR valve is open but air passage through the first bore 114 is restricted by the position of the strangler 52. With this arrangement, the rate of passage of air to the engine can also be controlled, along with EGR valve operation, by a single electric motor.

Modifications can be made to the above described embodiments. For example, other forms of actuator may be used besides an electric motor.

I claim:

1. An exhaust gas recirculation valve for installation between an air intake and an exhaust of an engine comprising a housing having a first bore for connection with the air intake and a second bore for receiving exhaust gas from the exhaust, the second bore being at an angle to the first bore and opening into the first bore; a valve stem extending from the first bore into the second bore; a valve seat in the second bore at the opening of the second bore into the first bore; a valve head on the valve stem within the second bore and normally in engagement with the valve seat; eccentric drive means rotatably mounted in the first bore and connected to the valve stem; actuating means mounted on the housing and connected to the eccentric drive means, which, on actuation, rotates the eccentric drive means to move the valve stem to disengage the valve head from the valve seat.

2. An exhaust gas recirculation valve as claimed in claim 1, wherein the first and second bores extend substantially perpendicular to one another.

3. An exhaust gas recirculation valve as claimed in claim 1, wherein the actuating means is an electric motor which is mounted on the housing and has a drive shaft extending into the first bore, the drive shaft having a rotation axis substantially perpendicular to the second bore.

4. An exhaust gas recirculation valve as claimed in claim 3, wherein the eccentric drive means is a journal eccentric which is rotated by the drive shaft and is rotatably connected to the valve stem at a point offset from the drive shaft axis.

5. An exhaust gas recirculation valve as claimed in claim 1, wherein the first bore defines a portion of an air intake manifold for the diesel engine.

6. An exhaust gas recirculation valve as claimed in claim 5, wherein a flap valve is pivotably mounted in the first bore and is movable by the eccentric drive means on actuation of the actuating means.

* * * * *